US005510948A

United States Patent [19]

Tremaine et al.

[11] Patent Number: 5,510,948

[45] Date of Patent: Apr. 23, 1996

[54] LOW VOLTAGE POWER SUPPLY AND DISTRIBUTION CENTER

[75] Inventors: Susan C. Tremaine; John M. Tremaine, both of New Canaan, Conn.

[73] Assignee: Q Tran, Inc., South Norwalk, Conn.

[21] Appl. No.: 358,339

[22] Filed: Dec. 16, 1994

[51] Int. Cl.[6] ..... G05F 1/00

[52] U.S. Cl. ..... 361/90; 361/18; 361/38

[58] Field of Search ..... 361/90, 38, 41, 361/18, 93, 115; 315/219, 225; 363/56; 362/249, 147, 404

[56] References Cited

U.S. PATENT DOCUMENTS

| | | | |
|---|---|---|---|
| 2,636,929 | 4/1953 | Southwick | 175/298 |
| 2,675,526 | 4/1954 | Friberg | 336/90 |
| 2,747,731 | 5/1956 | Bonanno | 206/46 |
| 2,778,001 | 1/1957 | Girton | 339/147 |
| 2,857,449 | 10/1958 | Akins | 174/16 |
| 2,958,056 | 10/1960 | Di Giovanni | 336/30 |
| 3,098,990 | 7/1963 | Farrand et al. | 336/172 |
| 3,621,339 | 11/1971 | Hodgson | 317/103 |
| 3,987,387 | 10/1976 | Gruber | 336/67 |
| 4,332,002 | 5/1982 | Yamaguchi | 361/432 |
| 4,334,171 | 6/1982 | Parman | 315/199 |
| 4,408,154 | 10/1983 | Cote | 323/340 |
| 4,533,786 | 8/1985 | Borgmeyer et al. | 174/50 |
| 5,111,114 | 5/1992 | Wang | 315/225 |
| 5,168,422 | 12/1992 | Duncan | 361/377 |
| 5,177,325 | 1/1993 | Giammanco | 174/50 |
| 5,189,257 | 2/1993 | Borgmeyer et al. | 174/50 |
| 5,249,107 | 11/1993 | Poulsen | 362/249 |
| 5,307,254 | 4/1994 | Russello | 362/368 |
| 5,352,958 | 10/1994 | Cunningham | 315/291 |

*Primary Examiner*—A. D. Pellinen
*Assistant Examiner*—S. Jackson
*Attorney, Agent, or Firm*—Ware, Fressola, Van Der Sluys & Adolphson

[57] ABSTRACT

A low voltage power supply and distribution center comprises a housing (12) having three internal compartments including: a high voltage compartment (17), a low voltage distribution compartment (19), and a transformer compartment (21). The housing (12) is designed for surface or recessed mounting on or in a wall or ceiling. For recessed mounting, with the housing (12) surrounded with 20 cm (8 inches) of insulation, the maximum surface temperature of the housing is less than 90° C. The three compartments (17,19,21) are formed by a removable power tray (15) having a torodial transformer (132) mounted thereon. The low voltage compartment (19) comprises a fuse panel (150) for mounting a plurality of plug-in fuses (153) from which the low voltage power is distributed. The high voltage compartment (17) comprises a switch or a dimmer (131) in a high voltage line between the transformer (132) and the incoming high voltage line, or the dimmer or switch may be remotely installed on a wall. An optional choke (133) may be provided in the high voltage compartment (17) for use with a dimmer. Additionally, a primary current protection circuit (135) may be provided to add additional protection for over current conditions. A mounting cover (54) is provided to cover the housing (12) to provide a more refined appearance, and vent holes (60) are provided in the cover (54) in the area of the transformer (132). The low voltage power supply and distribution center may be used for a National Electrical Code (NEC) class 1 and/or a class 2 wiring installation.

28 Claims, 10 Drawing Sheets

LOW VOLTAGE POWER SUPPLY AND DISTRIBUTION CENTER

TECHNICAL FIELD

The present invention relates to a low voltage power supply, and more particularly, to a low voltage power supply and distribution center, for either surface or recessed mounting in a wall or ceiling, which provides a safe and reliable supply of power to at least one low voltage load.

BACKGROUND OF THE INVENTION

It is well known to use low voltage lighting, e.g., 12/24 volt halogen lighting for interior lighting. It has been found that such low voltage lighting greatly reduces power consumption as compared with known higher voltage lighting, e.g., standard 120 V light bulbs. Additionally, such low voltage lighting has a long service life in service and produces light of a quality which is highly desirable for residential, commercial and contract interior lighting.

In typical low voltage lighting applications, high voltage power, e.g., 120 V, is supplied directly to a low voltage lighting fixture, and the fixture includes a transformer to step down the power to the required low voltage level. A problem associated with such a fixture is that building codes typically require that access be provided so that the transformer can be replaced. Therefore, an access hole is required to be at least large enough to received a human hand. The typical code requirement is that an access hole be provided having a minimum diameter of 10 cm (4 inch) for accessing the transformer. However, the diameter of a typical low voltage lighting light bulb is between 3.5 and 5 cm (1.375 and 2 inches) having a trim or reflector assembly of a diameter between 5 and 7.5 cm (2 and 3 inches). The light bulb and trim or reflector assembly diameter is much smaller that the required 10 cm (4 inches) diameter access required by code, and therefore, a trim ring or other decorative device must be provided to reduce the size of the access hole to the size of the light bulb and trim or reflector assembly.

Another problem associated with known low voltage lighting fixtures having transformers mounted therein is that there may be a harmonic noise or hum made by the transformer at the frequency of the supply voltage. As is known in the art, such noise or hum is exasperated when the supply voltage is provided to the transformer via a dimmer. A dimmer is used to reduce the magnitude of the supply voltage, and therefore, the light intensity. When a large number of low voltage lighting fixtures are used in a lighting installation to light a large area, e.g., a restaurant dining room, all of the transformers used for each of the lighting fixtures can create an undesirable background noise, which can be appreciably louder when a dimmer is used.

DISCLOSURE OF THE INVENTION

An object of the present invention is to provide a low voltage power supply and distribution center, which may be mounted in or on a wall or ceiling, for supplying voltage to at least one low voltage load mounted remotely from the low voltage power supply and distribution center.

Another object of the present invention is to provide such a low voltage power supply and distribution center which is inherently protected against over temperature conditions without the requirement of using an external thermal protector, such as an insulation detector.

A still further object of the present invention is to provide a low voltage power supply and distribution center wherein a transformer of the low voltage power supply operates in a quiet and efficient manner and wherein the maximum surface temperature of the exterior of a housing of the distribution center is less than 90° centigrade when surrounded with 20 cm (8 inches) of insulation.

A further object of the present invention is to provide an improved low voltage power supply and distribution center for transforming power, provided by a high voltage source, to a lower voltage for distribution individually to a plurality of loads (lamps), each load being in a circuit that is protected against an over current condition.

Another object of the present invention is to provide a low voltage power supply and distribution center which may be used with National Electrical Code (NEC) class 1 and/or class 2 wiring installations.

According to the present invention, a low voltage power supply and distribution center comprises a housing having three internal compartments including: a high voltage supply compartment, a low voltage distribution compartment, and a transformer compartment; the housing is designed for surface mounting on a wall or ceiling, or recessed mounting within a wall or ceiling such that when the housing is surrounded with 20 cm (8 inches) of insulation, the maximum surface temperature of the housing is less than 90° C.

In further accord with the present invention, the three compartments within the housing are formed by a removable power tray having a toroidal transformer mounted thereon, which, when inserted within the housing, divides the housing into the three compartments. The toroidal transformer may be provided with an integral thermal-amperic device which interrupts current flow in response to either an over temperature or over current condition.

In still further accord with the present invention, the low voltage compartment, which is also referred to as the secondary compartment, comprises a distribution center for low voltage, high current power supplied by the transformer; wherein the low voltage distribution center is implemented using a fuse panel for mounting a plurality of fuses thereon from which the low voltage power is distributed. Plug-in type fuses may be used with the fuse panel for ease of fuse installation and maintenance, and fuse ratings are selected over a wide range, e.g., from 5 amps to 35 amps, including combinations thereof to support the design installation requirements, e.g. NEC class 1 and/or class 2 wiring.

According further to the present invention, the high voltage compartment may comprise a switch in the high voltage line between the transformer, in the transformer compartment, and the incoming high voltage line. Alternatively, the high voltage compartment may comprise a dimmer rather than a switch. The switch or dimmer may optionally be located remotely from the low voltage power supply and distribution center if desired. An optional choke may be provided in the high voltage compartment for use with a dimmer. The choke smoothes the electrical signal provided at the output of the dimmer, thereby reducing the noise produced by the transformer when used with a dimmer. Additionally, with either the switch or the choke and dimmer combination, a thermal, push to reset circuit breaker may be provided to add additional protection for over current conditions. For wiring installations that utilize live conductor technology, such as cable lighting where 2 live conductors are stretched through a space, an optional security auto fuse extension may be provided in the high voltage compartment. The security auto fuse extension is a solid state device which acts as a fast acting relay for securing power to the transformer when an increase in load is detected.

In further accord with the present invention, the transformer may be provided with numerous primary windings, and a voltage control switch may be provided in the high voltage compartment for switching in the various primary windings to thereby allow adjustment of the transformer secondary voltage provided to the low voltage compartment to account for voltage drop on the wiring between the low voltage power supply and distribution center and various low voltage loads (lamps).

According still further to the present invention, the housing is provided with a built in level for leveling the housing during installation on the surface or recess of a wall. A mounting cover is provided to cover the housing after completion of installation to provide a more refined appearance. Vent holes are provided in the housing cover to cover the area within the housing containing the transformer. The mounting assembly for mounting the cover to the housing is arranged so that the cover may only be installed in one way with the vent holes position over the transformer compartment.

The removable power tray provides a significant advantage of easy insertion and removal of the power tray for easy installation of the housing in or on a wall or ceiling. Additionally, by removing the transformer from the housing (by removing the power tray) during the initial installation of the housing, the transformer can be protected from accumulation of dust, dirt and other construction debris, and may be installed after the heavy dust producing phase of a construction project is completed. It is important to keep dust and debris from accumulating on the transformer to maintain its superior characteristics, e.g., cooler, quieter and more efficient. A further significant advantage of providing the removable power tray is that the heavy transformer is removed from the housing during installation thereof, thereby greatly facilitating installation.

A toroidal transformer has been selected for use in the low voltage power supply application because of its size and efficiency characteristics. Additionally, it has been found that a toroidal transformer of the type used with the low voltage power supply may be used in a recessed, insulation contacting environment while maintaining an exterior housing temperature of less than 90° centigrade.

The foregoing and other objects, features and advantages of the present invention will become more apparent in light of the following detailed description of exemplary embodiments thereof, in view of the accompanying drawings.

BEST MODE FOR CARRYING OUT THE INVENTION

Figure 1:
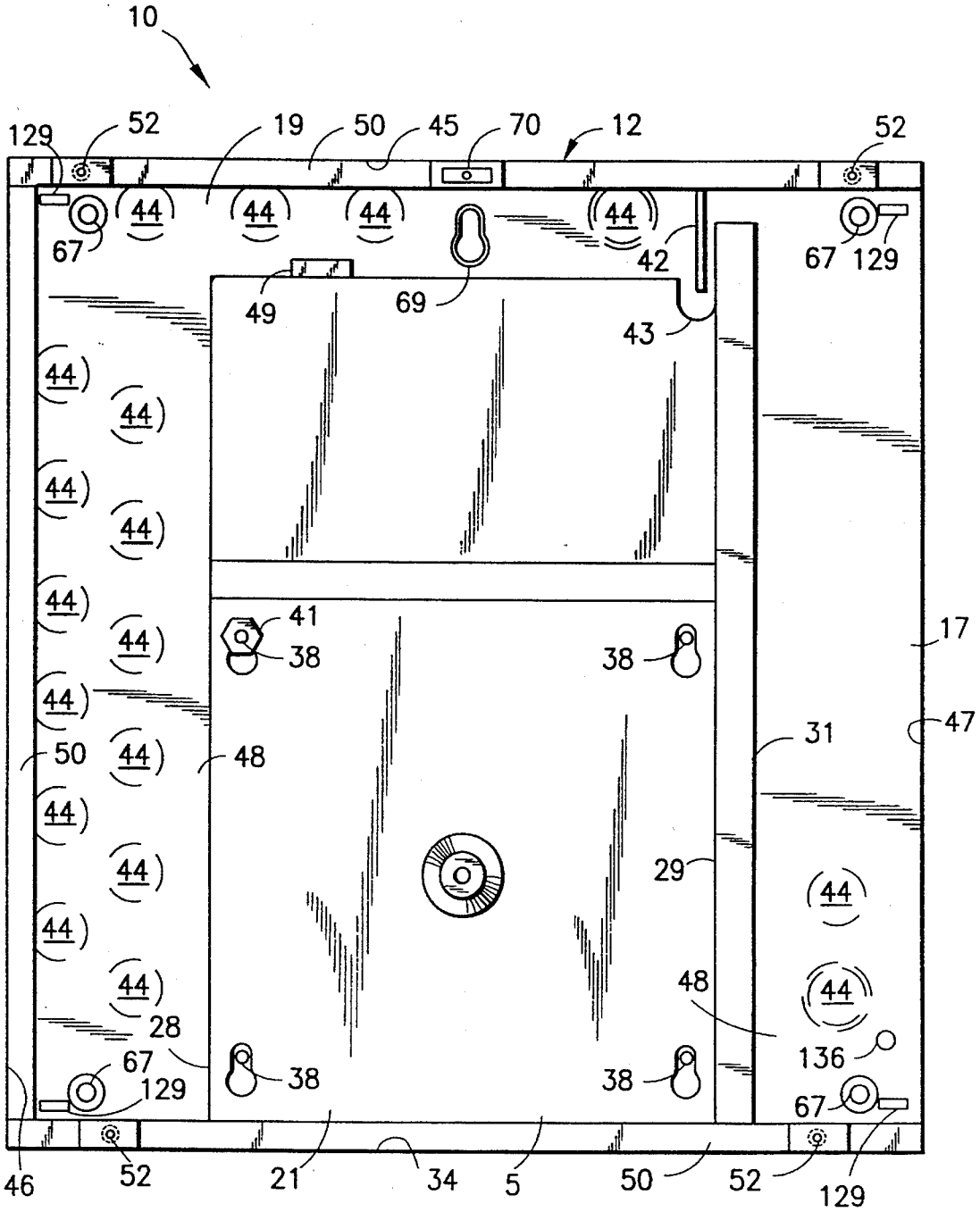
FIG. 1 is a front view of a low voltage power supply and distribution center housing, having a power tray installed therein, in accordance with the present invention.

Referring to FIG. 1, the low voltage power supply and distribution center 10 of the present invention comprises a generally rectangular shaped housing 12 having a bottom wall 34, a top wall 45 a left side wall 46 and a right side wall 47, all of which extend generally perpendicular from a back surface (rear wall) 48 to thereby defines a rectangular shaped housing chamber. The housing chamber is internally divided into three compartments by a removable power tray 15, including a high voltage (primary) compartment 17, a low voltage (secondary) compartment 19 and a transformer compartment 21. In the example of the low voltage power supply and distribution center described herein, the total volume of the housing chamber is approximately 9750 $cm^3$ (595 cubic inches), with the transformer compartment being approximately 3523 $cm^3$ (215 cubic inches), the high voltage compartment being approximately 1966 $cm^3$ (120 cubic inches) and the low voltage compartment being approximately 4260 $cm^3$ (260 cubic inches).

Figure 6:
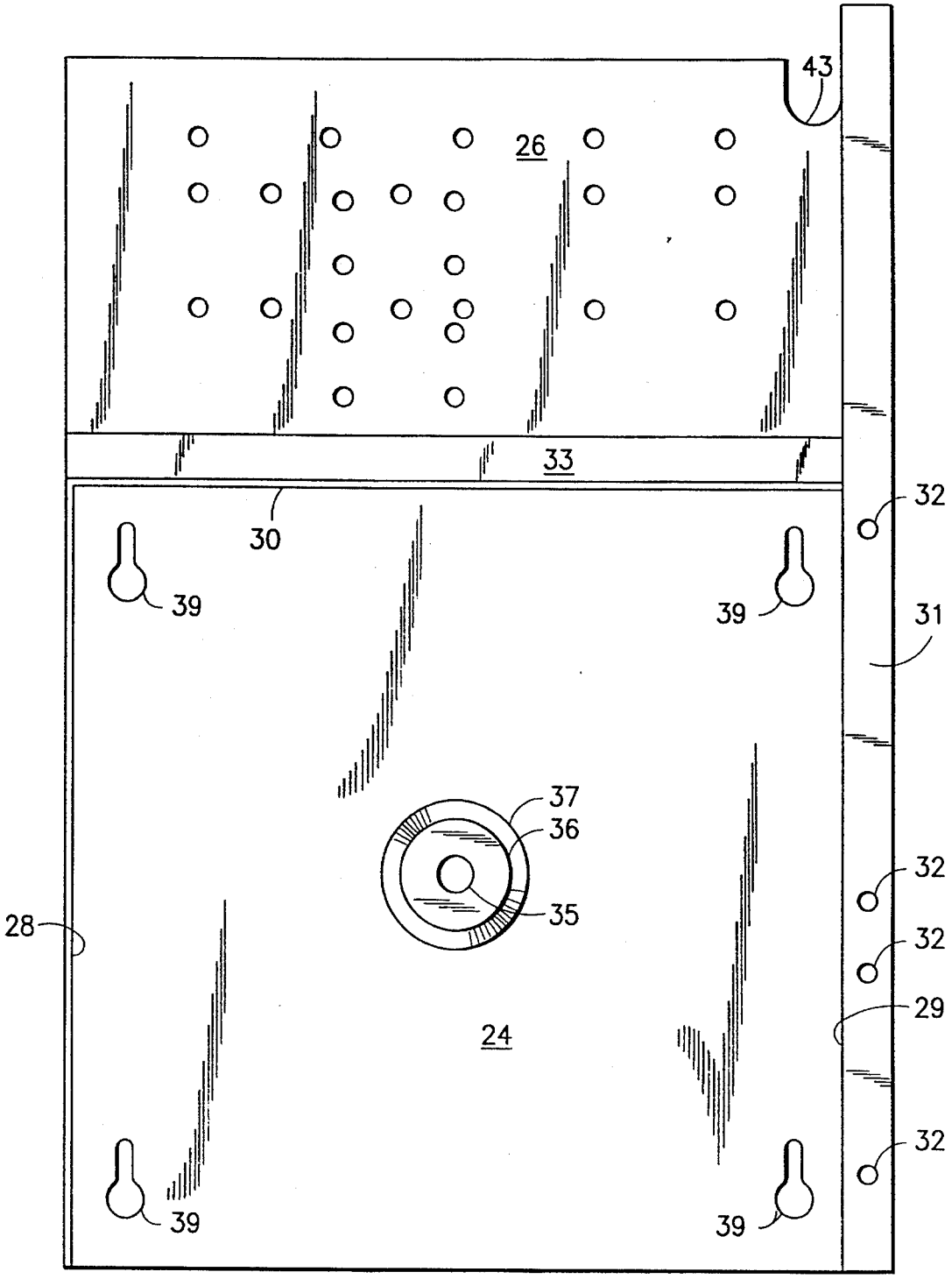
FIG. 6 is a front view of a power tray of the low voltage power supply and distribution center housing of FIG. 1.

Referring also to FIG. 6, the removable power tray 15 comprises a transformer mounting surface 24, a fuse holder mounting surface 26, and a plurality of divider walls 28, 29, 30. The divider walls 28, 29, 30 extend perpendicular to the fuse holder and transformer mounting surfaces 24, 26, and define the three compartments of the housing 12 when installed therein. Two of the divider walls 28, 29 are formed on opposite sides of the power tray 15. The power tray 15 may be formed of sheet metal or other suitable high strength material. The two opposing divider walls 28, 29 are formed by bending the sheet metal of the tray 15 to thereby define its structure. Alternatively, the two opposing divider walls 28, 29 may be attached to the power tray 15 by spot welding or high strength adhesive. One of the opposing divider walls 29 adjacent to the high voltage compartment 17 includes a flange surface 31 which extends into the high voltage compartment 17. A plurality of apertures 32 are formed in the flange surface 31 for mounting of various components in the high voltage compartment 17, as will be described in greater detail hereinafter.

The third divider wall 30 extends horizontally between the two opposing divider walls 28, 29, and is mounted to the power tray 15 between the transformer mounting surface 24 and the fuse holder mounting surface 26 by an angled portion 33 of the third divider wall 30. The third divider wall may be mounted to the power tray 15 by the angled portion 33 by a suitable method such as spot welding or high strength adhesive, e.g., epoxy adhesive.

Figure 2:
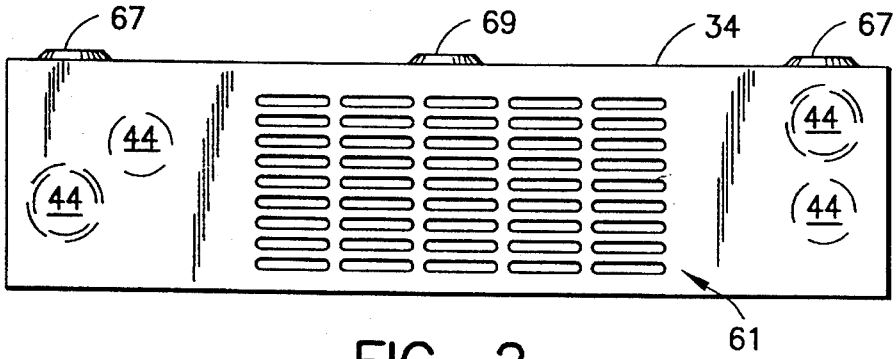
FIG. 2 is a bottom view of the low voltage power supply and distribution center housing of FIG. 1.
Figure 3:
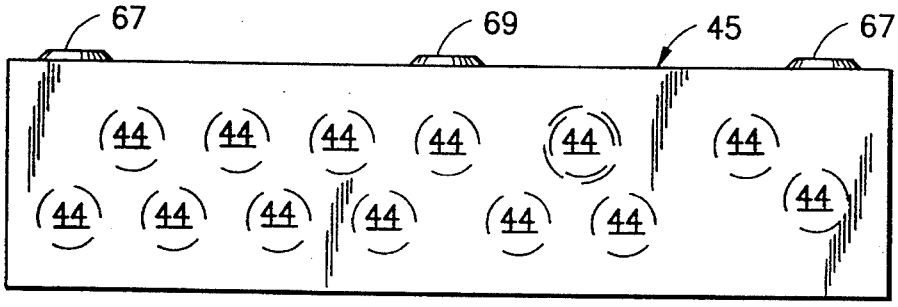
FIG. 3 is a top view of the low voltage power supply and distribution center housing of FIG. 1.
Figure 7:
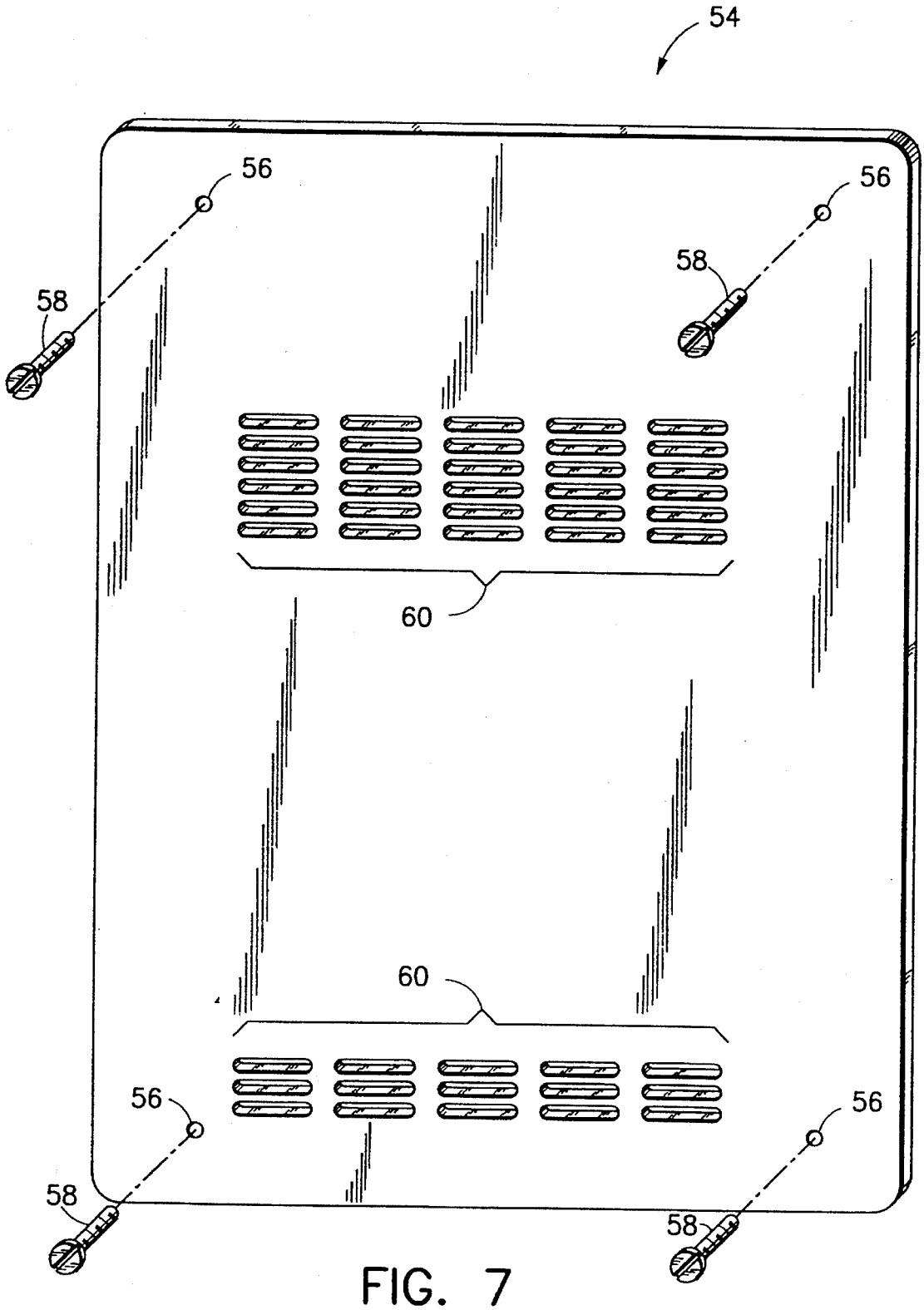
FIG. 7 is a top view of a housing cover for the low voltage power supply and distribution center housing of FIG. 1.

The three divider walls 28, 29, 30 and a bottom housing wall 34 (FIG. 2) define the transformer compartment 21. In the center of the transformer compartment, a transformer mounting aperture 35 is formed in the transformer mounting surface 24 of the power tray 15 for mounting a toroidal transformer to the power tray 15 within the transformer compartment 21. A raised surface 36 and angled surface 37 are formed in the transformer mounting surface 24, concentric to the transformer mounting aperture 35, for engagement with a central aperture of the toroidal transformer (not shown) for alignment and secure mounting of the transformer within the transformer compartment 21. The toroidal transformer central aperture may be potted with a metal insert, having a central threaded aperture, inserted from below. A nut is received through the transformer mounting aperture 35 for engagement with the threads of the metal insert for securely mounting the transformer to the power tray. This transformer mounting arrangement places far less stress on the transformer because no washer and nut combination is required for securing the transformer to the power tray. Therefore, compression and possible damage to the transformer windings is avoided. Additionally, this arrangement provides for secure mounting of the transformer and minimizes the possibility of the transformer moving on the power tray. Finally, if a nut, washer and bolt combination is used, there is a possibility that the bolt could contact the housing or housing cover 54 (FIG. 7). In this case, the housing will act as a high resistance winding to the transformer which could generate a large amount of heat and present a potential fire hazard.

Four studs 38 are attached to the housing 12 and are received through key-hole type mounting apertures 39 of the power tray 15 for mounting the power tray to the housing 12. The studs may be attached to the housing by spot welding, self clinching, or other suitable mounting method. For secure mounting of the power tray 15 to the housing 12, the power tray 15 is positioned within the housing 12 such that the studs 38 project through the mounting apertures 39. Next, nuts 41, e.g., self locking nuts having nylon inserts, are received onto the studs 38 and tightened down for securely mounting the power tray 15 to the housing 12. Because key-hole type mounting apertures 39 are used on the power tray 15, the nuts may be loosely mounted on the studs 38 prior to insertion of the power tray with in the housing. The nuts 41 may be received through the large diameter ends of the key-hole shaped mounting apertures 39. It will also be understood by those skilled in the art the because of the key-hole shape of the mounting apertures, the nuts do not have to be completely removed for removal of the power tray from the housing. Although only one nut 41 is shown, a nut 41 is provided on each of the studs 38 for secure mounting of the power tray 15 within the housing 12.

A lance 49 is provided in a back surface (rear wall) 48 of the housing which secures the power tray 15 in place. The lance 49 is a raised surface which may be formed by cutting and bending the sheet metal of the power tray 15. Once the power tray is positioned within the housing with the studs 38 positioned at the smaller diameter end of the key-hole shaped mounting apertures 39, the lance 49 contacts an edge of the power tray adjacent to the fuse holder mounting surface 26 (FIG. 6) for securely holding the power tray in position within the housing 12. The unique mounting method of the power tray within the housing using studs 38 received through key-hole type mounting apertures 39 and the lance 49 prevents the power tray from shifting within the housing or falling out of the housing in response to shaking movement of the housing which could be experienced, for example, during shipping or during an earthquake.

As will be described in greater detail hereinafter, during initial installation of the low voltage power supply and distribution center 10, the housing is typically mounted on or within a wall or ceiling without the power tray installed. This installation method facilitates easy wiring of the housing. Additionally, the transformer mounted on the power tray 15 is heavy, and installation without the power tray and transformer facilitates installation of the housing in or on a wall or ceiling. The power tray is later installed after "rough-in"wiring of the housing is complete and the housing is securely mounted in or on the wall or ceiling.

The one opposing divider wall 29 adjacent to the high voltage compartment 17 does not completely separate the low voltage compartment 19 and the high voltage compartment 17. Therefore, an extension wall 42 is attached to a top housing wall 45. The extension wall 42 extends perpendicular to the top hosing wall 45 and is positioned such that it is adjacent to the one opposing divider wall 29 when the power tray 15 is installed within the housing 12. A cutout 43 is formed in the fuse holder mounting surface 26 (FIG. 2) such that the one opposing divider wall 29 and the extension wall 42 overlap.

Figure 4:
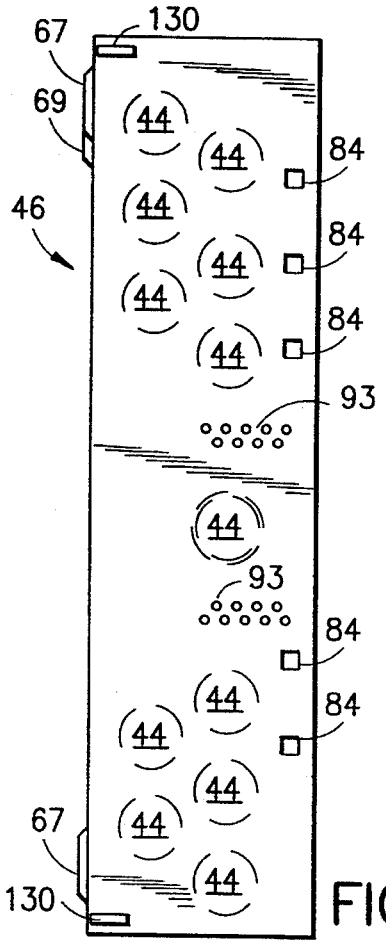
FIG. 4 is a left side view of the low voltage power supply and distribution center housing of FIG. 1.
Figure 5:
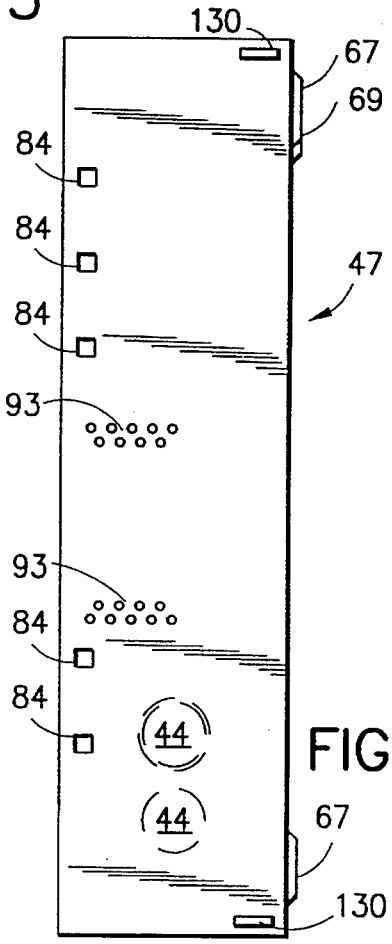
FIG. 5 is a right side view of the low voltage power supply and distribution center housing of FIG. 1.

Referring to FIGS. 1–5, a plurality of knockouts 44 are formed in various locations of the housing and power tray on both horizontal and vertical surfaces thereof. As is known in the art, the knockouts are stampings or precut portions of the sheet metal surface which are removable in response to a sufficient application of force thereto. The knockouts may be "double" knockouts, which may be opened to a larger diameter for receiving additional wiring. The knockouts are formed within the housing on the major surfaces of the housing within the low voltage compartment 19 and the high voltage compartment 17. As shown in FIG. 1, there are 16 knockouts including 15 single knockouts and 1 double knockout in the back surface (rear wall) 48 of the housing in the low voltage compartment 19. Additionally, there are 11 single knockouts and one double knockout in the left side wall 46 (FIG. 4), one single and one double knockout in the bottom wall 34 (FIG. 2) and 10 single and one double knockout in the top wall 45 (FIG. 3) of the housing for the low voltage compartment 19. For the high voltage compartment 17, there is one double and one single knockout in the back surface (rear wall) 48, bottom wall 34 (FIG. 2) and right side wall 47 (FIG. 5). Additionally, there are two single knockouts in the top wall 45 (FIG. 3) for the high voltage compartment. In addition to formation of knockouts 44 on the major surface of the housing 15, apertures may be formed in the power tray divider walls 28, 29, 30 so that appropriate wiring may be provided between the various compartments.

Referring again to FIG. 1, a flange surface 50 is formed in the bottom housing wall 34, the top housing wall 45 and the left side housing walls 46. The flange surfaces 50 provide structural strength and rigidity, and also provide a mounting surface for mounting a housing cover 54 (FIG. 7) to the housing 12. Referring also to FIG. 7, the housing cover 54 is provided for mounting to the housing 12 for enclosing the interior compartments of the housing. Apertures 56 are formed in the housing cover 54 for receiving threaded fasteners 58 therethrough. The threaded fasteners 58 may be captive for ease of installation of the housing cover 54. The threaded fasteners 58 are arranged for engagement with threaded apertures 52 formed in the flange surfaces 50 for securing the housing cover 54 to the housing 12. Ventilation apertures 60 are formed in the housing cover 54 for ventilating the transformer compartment 21. For additional ventilation of the transformer compartment 21, ventilation apertures 61 may also be provided in the bottom housing wall 34. The threaded apertures 52 and the apertures 56 in the housing cover 54 are arranged so that when the housing cover 54 is mounted to the housing 12 with all four threaded fasteners 58, the ventilation apertures 60 will cover the transformer compartment 21. The height of the divider walls 28, 29, 30 and the extension wall 42 is selected to extend to the housing cover 54 when the power tray 15 is properly secured to the housing 12, to thereby provide separation between the three compartments 17, 19, 21.

Figure 8:
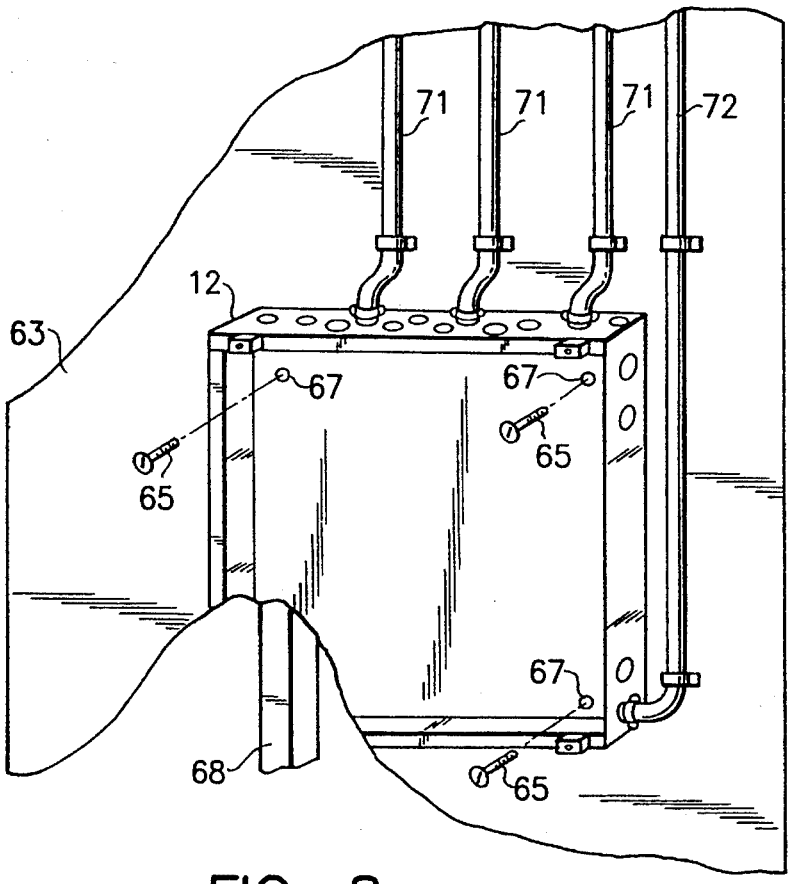
FIG. 8 is a perspective view, partially broken away, of a housing mounted on the surface of a wall with wiring entering the housing through a top housing wall and a side housing wall.
Figure 9:
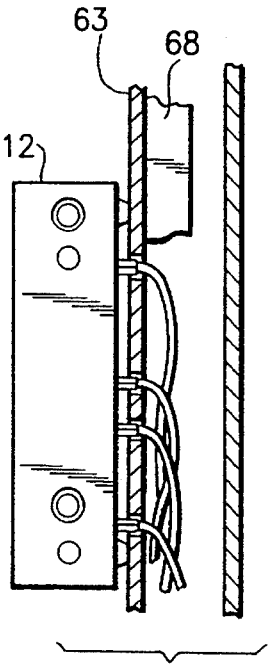
FIG. 9 is a perspective view, partially broken away, of a housing mounted on the surface of a wall with wiring entering the housing through the back of the housing.

As discussed hereinabove, the housing 12 is suitable for either surface mounting on a wall or ceiling or mounting within a wall or ceiling. An illustration of two surface mounting configurations of the housing are shown in FIGS. 8 and 9. Referring to FIGS. 1 and 8, the housing 12 is mounted to a wall 63 by screw fasteners 65 received through apertures 67 formed in the housing 12. The apertures 67 are formed in a contoured surface which projects outwardly from the housing. The fasteners 65 engage with a stud 68, e.g., framing lumber, or other suitable structural support for securely mounting the housing 12 to the wall 63. To facilitate mounting of the housing 12 to the wall 63, a central key-hole aperture 69, also formed in a contoured surface which projects outwardly from the housing, is provided in the center of the housing 12 adjacent to the top housing wall 45 so that the housing may be hung on a support, e.g., a nail or other suitable screw-type fastener. The contoured surfaces of the apertures 67 and the central key-hole aperture 69 act as a stand-off for providing a small space between the housing and a wall it is mounted on. This space provides for air circulation behind the installed housing for cooling purposes.

A bubble level 70 is built into the center of the flange surface 50 of the top housing wall 45 for leveling the housing prior to permanent attachment to the wall. The level 70 is provided to assure that the final housing installation will provide for the level placement of the housing cover for a more refined appearance. As described hereinabove, wiring 71 for the low voltage compartment 19 and wiring 72 for the high voltage compartment 17 are received through various knockouts. The apertures for receiving the wiring 71, 72 are provided by removing the appropriate knockout stampings.

In the illustrated configuration of FIG. 8, the wiring 71,72 is received through the top housing wall 45 and a side housing wall 47 with appropriate knockouts removed for wiring of both the high voltage compartment 17 and the low voltage compartment 19. In an alternative mounting illustration of FIG. 9, the housing is mounted to the wall 63 in the same way using fasteners 65 (FIG. 8) through the apertures 67 (FIG. 8) formed in the housing 12, however, the wiring 71, 72 is received through knockout stampings 44 removed from the back surface (rear wall) 48 of the housing 12 within the proper compartments. Using this configuration, both the high voltage wiring 72 and low voltage wiring 71 may be contained within a wall 63 while the housing 12 is mounted external to the wall 63 on the surface thereof.

Figure 10:
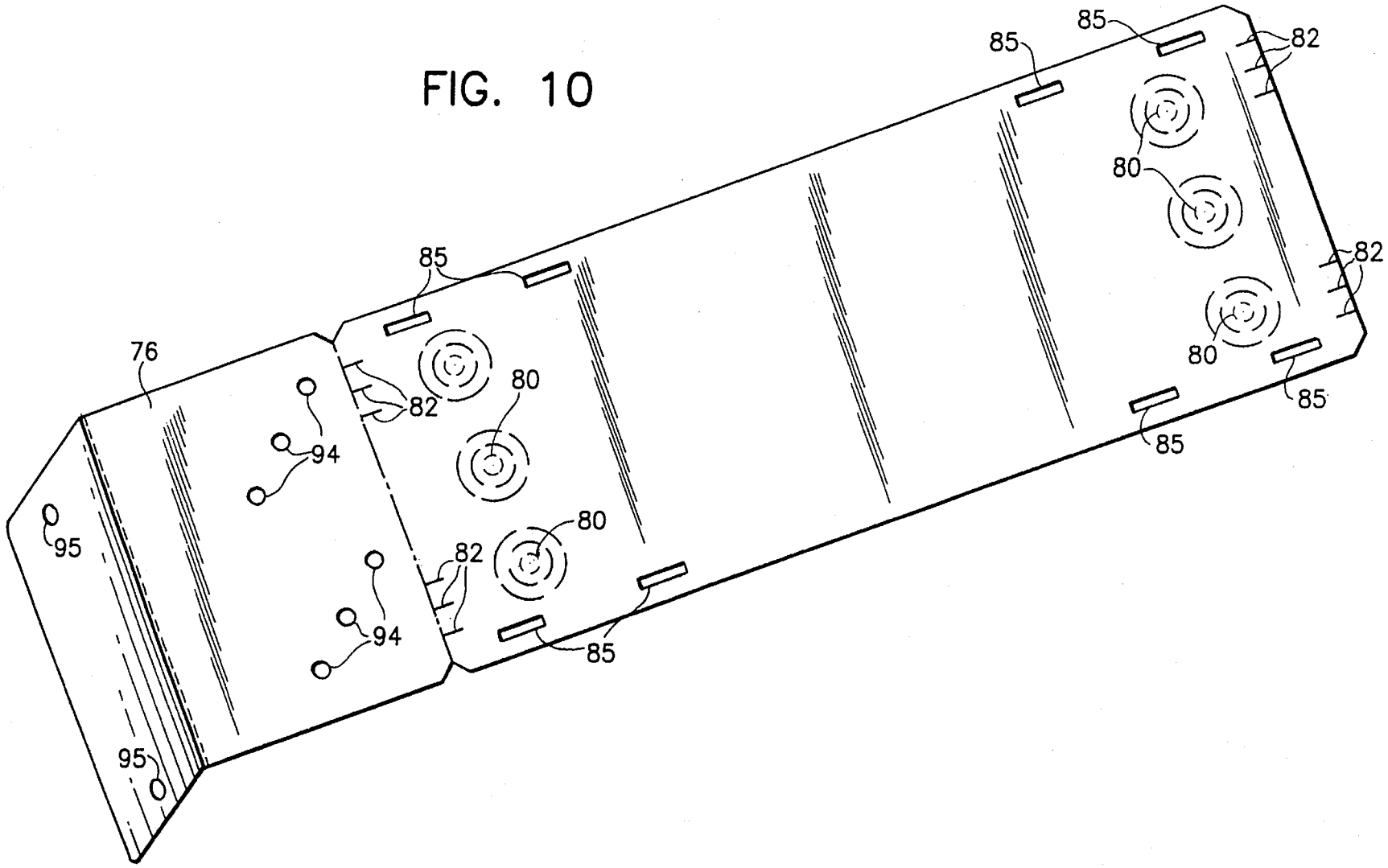
FIG. 10 is a perspective view of a hinge bracket and support bracket for mounting the housing within a wall or ceiling.
Figure 11:
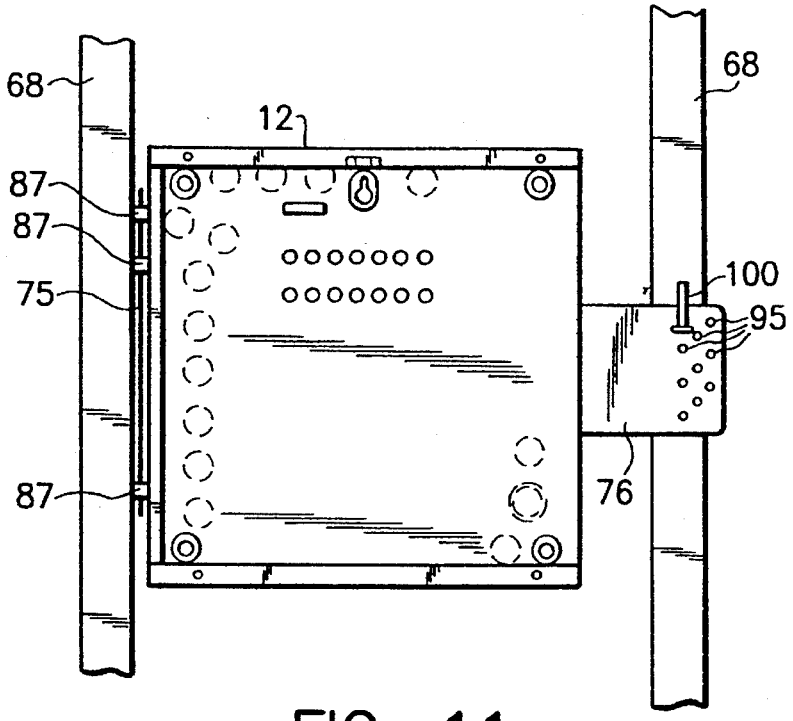
FIG. 11 is a front view of a housing mounted within a wall using the hinge bracket and support bracket of FIG. 10.

Referring to FIGS. 10 and 11, a hinge bracket 75 and support bracket 76 are provided for mounting of the housing 12 within a wall or ceiling. The hinge bracket 75 and support bracket 76 are provided as a single unit, and are separated along a bend and break line 78. The hinge bracket 75 comprises a plurality of apertures 80 formed therein for receiving fasteners, such as nails or screws, for mounting of the hinge bracket 75 to a stud 68 within the wall or ceiling. Appropriate markings 82 are provided on either end of the hinge bracket 75 for positioning of the hinge bracket 75 with respect to the stud 68 to control the depth of the housing 12 within the wall or ceiling.

Figure 12:
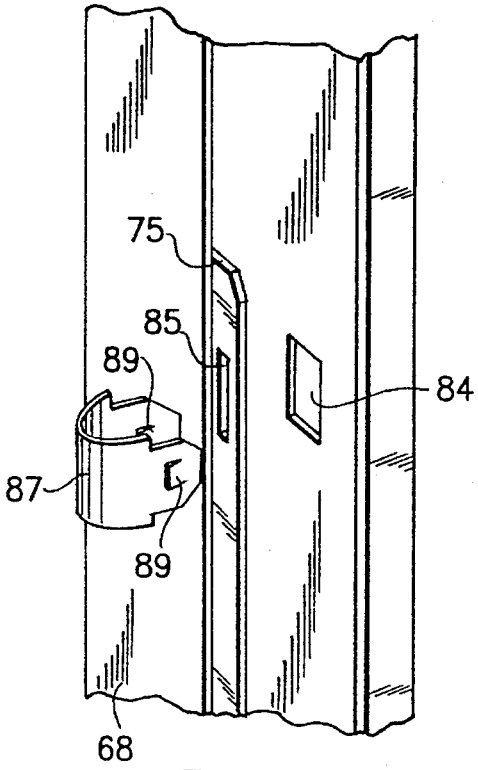
FIG. 12 is a perspective view, partially broken away, of a U-shaped hinge for mounting the housing to the hinge bracket.

Referring also to FIGS. 4, 5 and 12, bracket apertures 84 are formed within the left and right side housing walls 46, 47 (FIGS. 4 and 5) for snap fit engagement of U-shaped hinges 87. On either side of the U-shaped hinges 87, detentes 89 are formed for engagement with the housing 12 within the bracket apertures 84. During assembly of the hinge bracket 75 to a side of the housing 12, one side of the U-shaped hinge 87 is inserted through a hinge aperture 85 in the hinge bracket 75, and then the U-shaped hinge 87 is inserted into the bracket aperture 84 of the housing until both of the detentes 89 are in snap fit engagement with the sides of the apertures 84 of the housing. Both sides of the hinge bracket 75 have identically spaced hinge apertures 85, and similarly, both the left and right side housing walls 46, 47 (FIGS. 4 and 5) have identically spaced bracket apertures 84 so that the housing 12 may be mounted to the hinge bracket 75 on either side thereof.

The angled support bracket 76 is mounted to the opposite side of the housing 12 from the hinge bracket 75. As illustrated in FIG. 10, a pair of support bracket mounting apertures 95 are formed in the support bracket 76 for receiving threaded fasteners therethrough for engagement with rows of apertures 93 (FIGS. 4 and 5) formed in the left and right side housing walls 46, 47. The various rows of apertures 93 formed in the side housing walls are provided so that the depth at which the housing is mounted within the wall or ceiling may be controlled on both sides of the housing. Additionally, rows of apertures 94 are provided in the other leg of the support bracket 76 so that the support bracket may be permanently attached to a stud 68 after final assembly of the housing. The various rows of apertures 94 are provided so that a fastener received through on row of the apertures at a generally central location on a stud 68.

Figure 13:
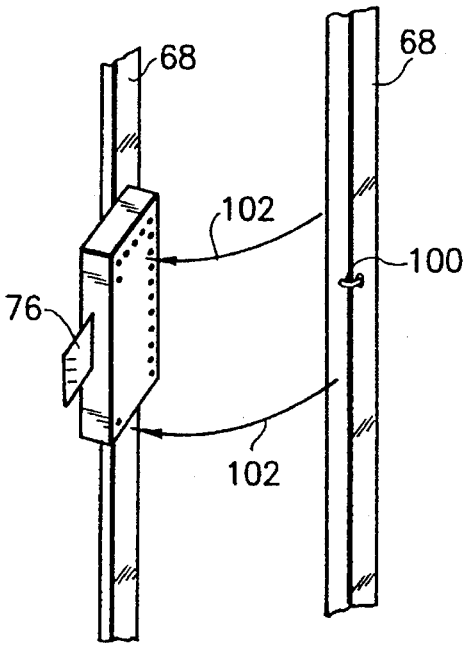
FIG. 13 is a perspective view of the housing being swung on the hinge bracket.

Referring to FIGS. 11 and 13, during initial installation of the housing 12 using the hinge bracket 75 and support bracket 76, the power tray 15 (FIG. 2) is removed from the housing 12. The housing 12 is attached to a stud 68 on one side using the hinge bracket 75, and the housing is secured against swinging movement by retaining the support bracket 76 using, for example, a temporary nail 100 partially driven into a stud 68 and bent at an angle so as to engage the support bracket 76 and prevent it from moving. After installation, the housing 12 may be swung on the hinge bracket 75, as shown for example by direction arrows 102. To allow swinging movement of the housing 12 on the hinge bracket 75, the nail 100 is repositioned, e.g., by pivoting, thereby freeing the support bracket 76. After "rough-in" wiring of the housing 12 is complete, the temporary nail is removed, and the housing may be permanently attached in place by fasteners received through the support bracket apertures 94 into a stud 68. Prior to permanent mounting, the housing may be leveled using the bubble level 70.

Figure 14:
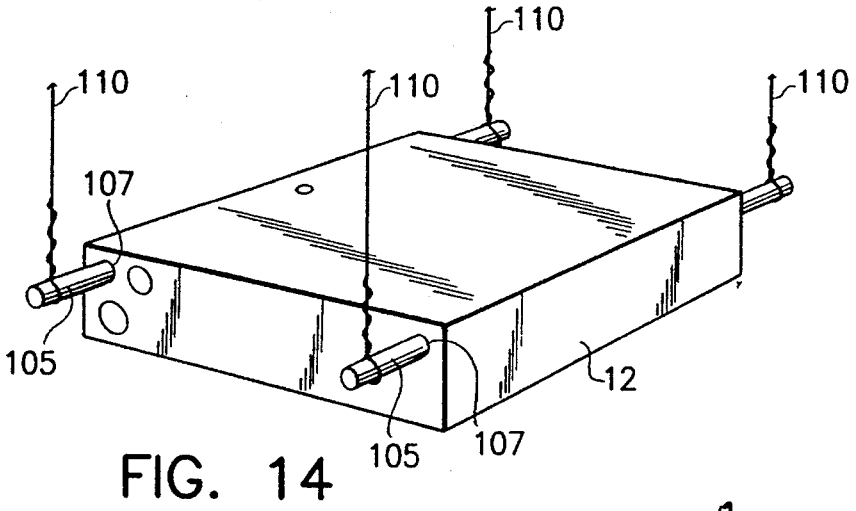
FIG. 14 is a perspective view of a first alternative housing mounting method using conduit and wire.
Figure 15:
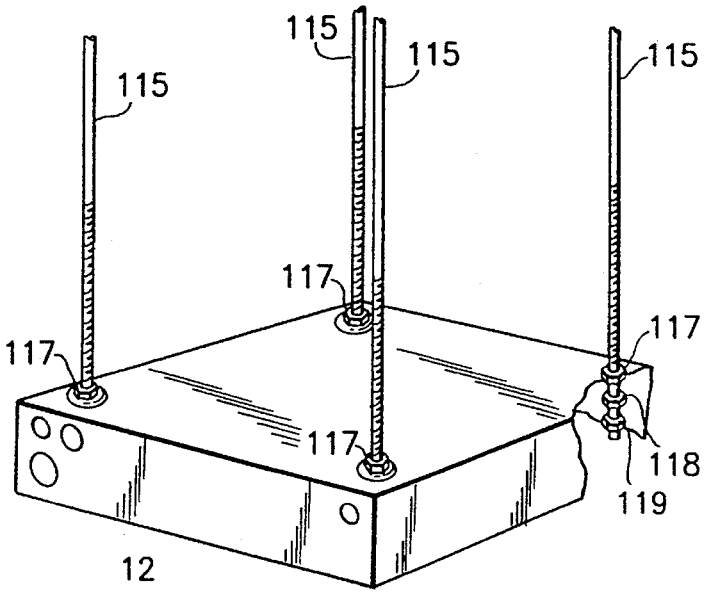
FIG. 15 is a perspective view of a second alternative housing mounting method using threaded rods and nuts.
Figure 16:
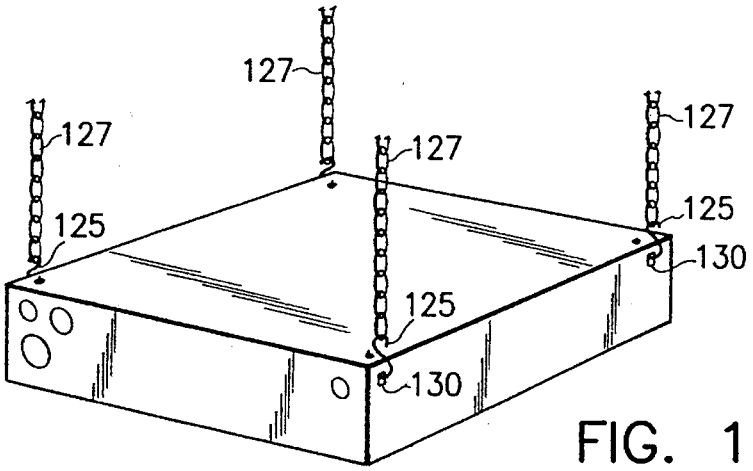
FIG. 16 is a perspective view of a third alternative housing mounting method using hooks and chain supports.

FIGS. 14, 15 and 16 show three different mounting configurations for mounting the housing within a ceiling. In the configuration of FIG. 14, conduit 105 is received through opposed, aligned knockouts 107 in the opposite side housing walls 46, 47, and the housing 12 is suspended by the conduit 105 from the ceiling (not shown) using wire 110 which is attached at one end to the conduit 105 and attached at the other end to the ceiling. In the mounting configuration example shown in FIG. 15, the housing 12 is suspended by threaded rods 115 which are attached at one end to the ceiling. The other ends of the threaded rods 115 are received through the apertures 67 formed in the housing 12. Each of the threaded rods 115 is securely mounted to the housing 12 using a first mounting nut 117 positioned outside of the housing, and a washer, second mounting nut 118 and a locking nut 119 positioned within the housing 12.

Referring to FIG. 16, a third mounting configuration is illustrated wherein the housing 12 is supported by S-shaped hooks 125 which are attached to chains 127 mounted to the ceiling (not shown). The housing 12 is supported on the chains 127 by the hooks 125 which are received through apertures 130 formed in the opposing side housing walls 46, 47 (FIGS. 4 and 5), as well as apertures 129 formed in the back surface (rear wall) 48 of the housing 12 (FIG. 1).

Figure 17:
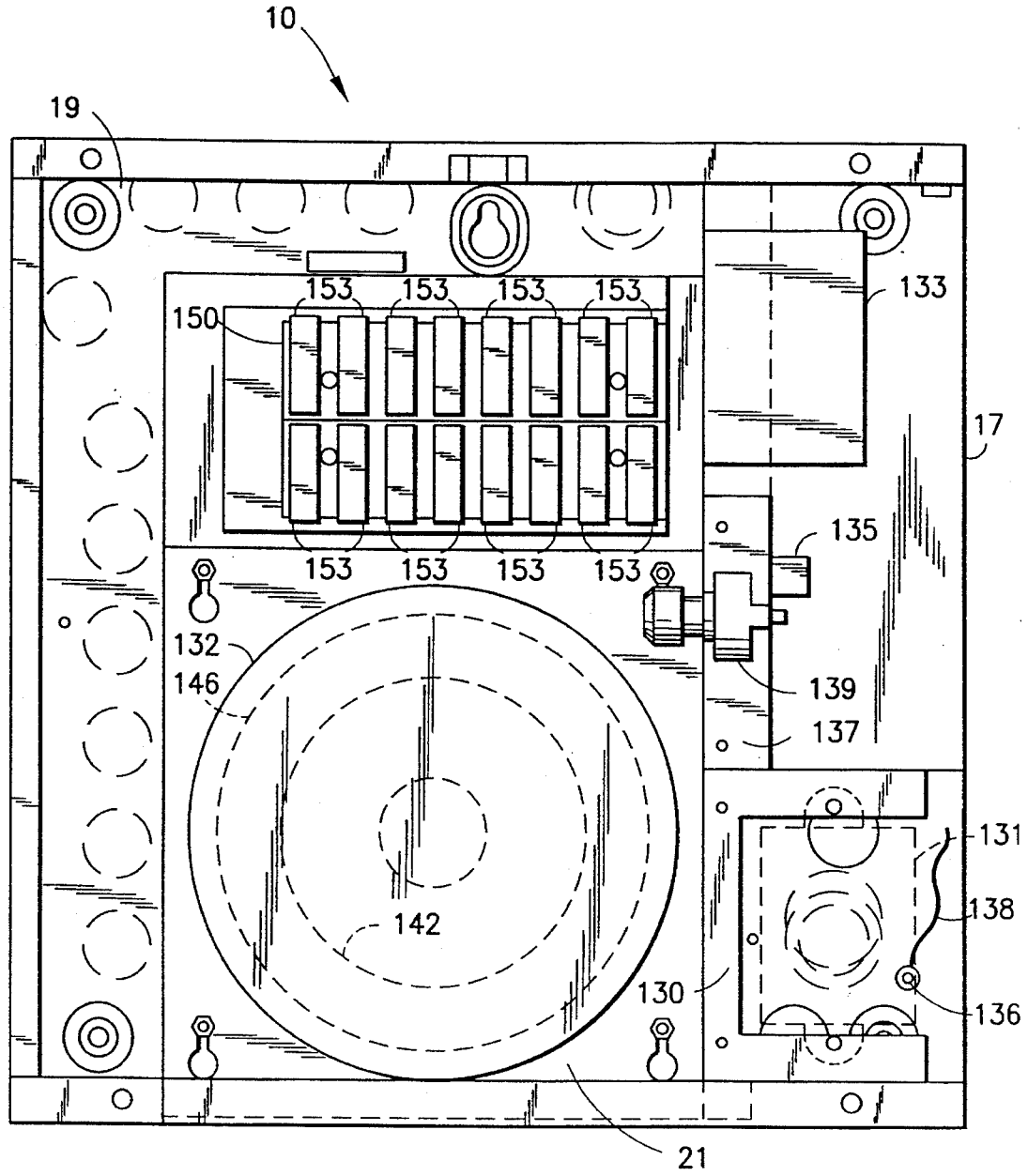
FIG. 17 is a top view of the housing having various components mounted therein.

Referring to FIG. 17, an exemplary configuration of the low voltage power supply and distribution center 10 is shown. In the high voltage compartment 17, an optional switch or dimmer mounting bracket 130 can be provided for mounting either a conventional on/off switch (not shown) or a dimmer 131 (shown in phantom). A switch or dimmer 131 is used in the mounting bracket 130 of the high voltage compartment 17 for switching on and off or dimming the power to a transformer 132 located in the transformer compartment 21. Additionally, if a dimmer 131 is used, the magnitude of the voltage supplied to the transformer may be varied for controlling the output voltage to the low voltage loads (lamps) connected to the low voltage power supply and distribution center. If a dimmer 131 is used in the mounting bracket 130 of the high voltage compartment 17, a choke 133 may be provided in line with the dimmer 131. The choke 133 smoothes the output signal provided by the dimmer 131 to thereby minimize noise generated by the transformer 132 during operation. If live conductor technology is used for the wiring installation, a security auto fuse extension 137 may be used in the high voltage compartment to rapidly secure power to the transformer when an increase in load is detected. The increase in load may be indicated by an increase in current.

A push to reset thermal circuit breaker 135 may be included in the high voltage compartment 17 at the output of the choke 132, or at the output of a switch installed in the bracket 130. The circuit breaker 135 is used to interrupt the power supply to a transformer 132 in response to an over current condition sensed by the circuit breaker 135, thereby protecting the circuit. A ground wire stud 136 is provided in the high voltage compartment 17 for mounting a ground wire 138. The ground wire 138 is provided with a ring terminal which is secured in place on the stud 136 by a self-locking nut, e.g., a nut having a nylon insert. The ground wire stud 136 may be spot welded,self clinching, or attached in place using any suitable mounting method.

As is known in the art, when a dimmer 131 is used with a transformer, a voltage drop occurs across the dimmer 131 so that the rated voltage is not supplied to the transformer 132, even at the maximum output of the dimmer 131. Additionally, voltage drops occur over the various cabling located within the power supply and distribution center 10, and also over the wiring between the low voltage power supply and distribution center 10 and low voltage loads (lamps). Therefore, a voltage control switch 139 is provided for switching in and out various primary windings of the transformer 132 located in the transformer compartment 21. As is well known in the art, the ratio of primary voltage ($V_P$) to secondary voltage ($V_S$) is directly related to the ratio of the number of primary turns ($N_P$) to the number of secondary turns ($N_S$) as given by the following relationship:

$$\left[\frac{V_P}{V_S}\right]=\left[\frac{N_P}{N_S}\right]$$

Therefore, as is well known in the art, the output voltage (secondary voltage) of a transformer is controlled by the ratio of primary windings to secondary windings. This well known relationship is utilized by the voltage control switch 139 by switching in and out various primary windings, each having a different number of windings, for controlling the output voltage (secondary voltage) of the transformer 132. It will be understood by those skilled in the art, that to increase the secondary voltage, a fewer number of primary windings is selected, and to reduce the secondary voltage, the number of primary windings selected is increased. The control of the voltage control switch 139 is selected to provide the desired output voltage at the low voltage load (lamp), taking into account the voltage drop caused by a dimmer 131 or switch, the low voltage power supply and distribution center wiring, and the wiring between the low voltage power supply distribution center 10 and the low voltage loads (lamps). For example, in a 12 V application, a four position, make and break rotary switch may be used to connect primary windings to nominally provide a secondary output of either 12, 13, 14 or 15 volts. Similarly, in a 24 V application, the switch may be used to connect primary windings to nominally provide a secondary output of either 24, 26, 28 or 30 volts.

The transformer compartment 21 is designed to accommodate various size toroidal transformers. The size of the toroidal transformer is directly related to its power rating. A toroidal transformer having a low power rating 142, e.g., 150 watts, is much smaller than a toroidal transformer having a large power rating 132, e.g., 750, 900 or 1050 watts. Intermediate size toroidal transformers 146 have intermediate power ratings, e.g., 300 watts, 500 watts and 600 watts. As is well known in the art, the size of a toroidal transformer varies with its power rating because of the size (gauge) of the wire used in the transformer and also the size of the magnetic core used with such a transformer. The transformers may be provided with an integral thermal-amperic device which interrupts current flow in response to either an over temperature or over current condition.

A fuse panel 150 is located within the low voltage compartment 19. The fuse panel 150 comprises a plurality of fuse holders for holding a plurality of fuses 153. A separate 5 amp fuse 153 is provided for each 12 volt low voltage load (lamp) connected to the low voltage power supply and distribution center 12 for class 2 wiring. For class 1 wiring, multiple low voltage loads may be connected to each fuse. In a class 1 wiring configuration, the number of low voltage loads connected to a fuse will depend on the fuse rating and the amperage of the loads. As will be understood by those skilled in the art, the number of fuses required for a given installation will depend on the size (power rating) of the various low voltage loads connected to the low voltage power supply and distribution center 10, and the total load connected to the low voltage power supply and distribution center is dependent upon the power rating of the transformer. The following table gives an example of the number of 5 amp fuses used in an installation having a 120 volt primary supply and a 12 volt secondary supply based on the power rating of the transformer used:

| TRANSFORMER RATING (WATTS) | PRIMARY RATING | SECONDARY RATING | NO. OF SECONDARY 12 V/5 AMP FUSES |
|---|---|---|---|
| 150 | 120 V-1.4 A | 12 V-12.5 A | 3 |
| 300 | 120 V-2.7 A | 12 V-25.0 A | 6 |
| 450 | 120 V-4.0 A | 12 V-37.5 A | 9 |
| 500 | 120 V-4.4 A | 12 V-42.5 A | 10 |
| 600 | 120 V-5.2 A | 12 V-50.0 A | 12 |
| 750 | 120 V-6.5 A | 12 V-62.5 A | 15 |
| 900 | 120 V-7.8 A | 12 V-75.0 A | 18 |
| 1000 | 120 V-9.1 A | 12 V-87.5 A | 20 |

Using one of the above transformer and fuse combinations in a low voltage power supply and distribution center of the present invention, an installation may be provided which meets the requirements for class 2 wiring, as established by the National Electrical Code (NEC), by the National Fire Protection Association, Boston, Mass., U.S.A. Both the low voltage power supply and distribution center and the 12 volt, 5 amp wiring used with it meet the NEC class 2 wiring requirements. In an alternative configuration of the present invention, a transformer and fuse combination may be selected to meet the NEC class 1 wiring requirements. Using a configuration which meets NEC class 1 requirements, with either 12 or 24 volts, fuses of up to 35 amps may be used. A typical configuration which meets with NEC class 1 requirements would include 15 amp fused or a combination of 5 amp and 15 amp fuses, for either a 12 volt application or a 24 volt application. It is also expected that the low voltage power supply and distribution center of the present invention may be used in a combination NEC class 1 and class 2 configuration wherein a combination of 5 amp and 15 amp fuses are used. It will be understood by those skilled in the art that the overall load supplied by the low voltage power supply and distribution center is limited by the power rating of the toroidal transformer so used.

Figure 18:
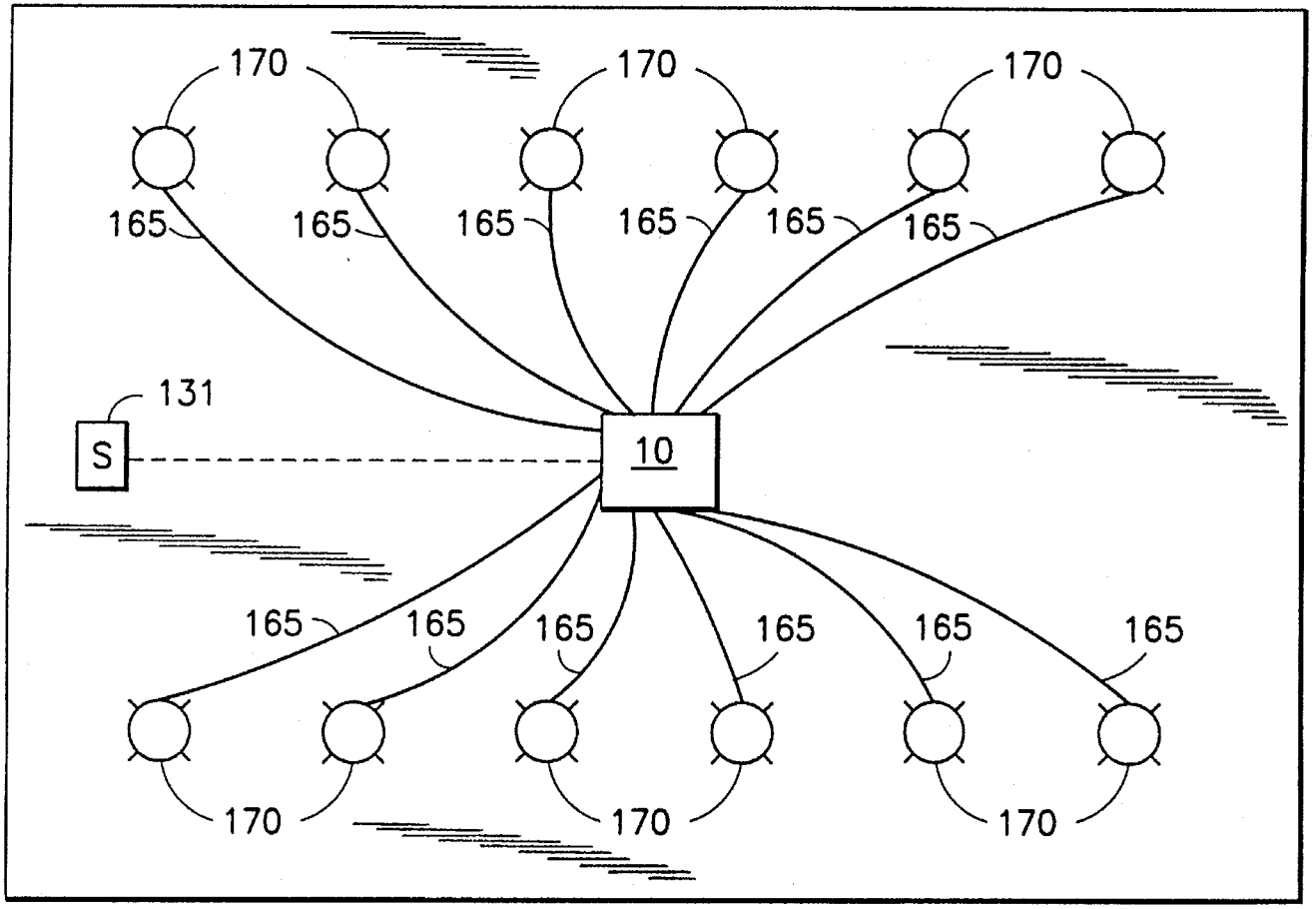
FIG. 18 is a schematic block diagram of an exemplary installation using the low voltage power supply and distribution center of the invention.

Referring now to FIG. 18, an exemplary NEC class 2 wiring installation configuration of the low voltage power supply and distribution center 10 is shown. In the example of FIG. 18, the low voltage power supply and distribution center 10 is mounted in a ceiling, and is supplied by a 120 volt supply. A dimmer 131 is located remotely from the low voltage power supply and distribution center 10, and the high voltage compartment includes both a choke 133 (FIG. 17) and a push to reset circuit breaker 135 (FIG. 17) on the primary. In the example of FIG. 18, a 600 watt transformer is used, and as described in the above table, twelve (12) 5 amp low voltage circuits are provided from the fuse panel 150 (FIG. 17) in the low voltage compartment 19. As is well known in the art, and as described above, a voltage drop will occur over the wiring 165 between the low voltage power supply and distribution center 10 and the various low voltage loads 170. In the example of FIG. 18, where all of the low voltage loads are lighting fixtures located within a ceiling, it is desirable that the same power be delivered to each of the lighting fixtures so that each lighting fixture provides light of the same intensity. Therefore, all secondary wiring runs 165 between the fuse panel 150 (FIG. 17) and the low voltage loads 170 are made with the same gauge wire of approximately the same length. Excess wire for the shorter runs may be neatly tied or stapled within the ceiling in long loops, as opposed to small coils. Additionally, it will be understood by those skilled in the art that the voltage control switch 139 may be used to switch in the appropriate primary winding to provide the desired voltage, e.g., 12 V or 24 V, to the loads (lamps). Although the installation is shown with the low voltage power supply and distribution center installed in a ceiling, it will be understood by those skilled in the art that the low voltage power supply and distribution center may be installed in or on a wall.

Although the invention is described with respect to FIG. 17 as having a switch or dimmer 131 mounted within the low voltage power supply and distribution center, the switch or dimmer may be positioned remotely from the low voltage power supply and distribution center, as illustrated in FIG. 18. Additionally, although the invention is described using 120 V supply for providing either a 12 V supply to 12 V loads or a 24 V supply to 24 V loads, it will be understood by those skilled in the art that various primary and secondary voltage combinations may be used depending on the desired application.

Although the power tray is shown and described as being made of sheet metal and including a spot welded wall, it will be understood by those skilled in the art that the power tray may be die cast, injection molded or formed in another suitable way.

Although the invention has been described and illustrated with respect to exemplary embodiments thereof, it should be understood by those skilled in the art that the foregoing and various other changes in the omissions may be made therein and thereto without departing from the spirit and scope of the present invention.

What is claimed is:

1. A low voltage power supply and distribution center, for mounting in or on a wall or ceiling, connected between a high voltage supply line and at least one low voltage distribution line, each low voltage distribution line being electrically connected to at least one low voltage load which is located remotely from said low power supply and distribution center, said low voltage power supply and distribution center comprising:

a housing having side housing walls extending generally perpendicular from a rear housing wall, thereby forming a housing chamber therein;

a power tray removably mounted within said housing chamber, said power tray dividing said housing chamber into three compartments including a high voltage compartment, a low voltage compartment and a transformer compartment;

a toroidal transformer, having primary windings and secondary windings, mounted within said transformer compartment, said primary windings being connected to the high voltage supply line in said high voltage compartment, said toroidal transformer reducing high voltage, supplied from said high voltage compartment on the high voltage supply line to said primary windings, into a lower voltage on said secondary windings;

low voltage distribution means mounted in said low voltage compartment and connected between said secondary windings and the low voltage distribution lines, said low voltage distribution means comprising circuit protection means for interrupting current to a low voltage distribution line in response to the current on the low voltage distribution line exceeding a predetermined threshold rating of said circuit protection means; and a housing cover, removably mounted to said side housing walls, opposite to said rear housing wall, for covering said housing chamber.

2. A low voltage power supply and distribution center, according to claim 1, wherein during installation of said housing within a wall or ceiling with said side housing walls and said rear housing wall in contact with 20 cm (8 inches) of insulation, the surface temperature of said side housing walls, said rear housing wall and said housing cover is less than 90° C. during operation of said transformer within said transformer compartment.

3. A low voltage power supply and distribution center, according to claim 2, wherein said transformer comprises thermal-amperic means for interrupting current flow to said low voltage distribution means in response to the temperature of said primary windings or said secondary windings exceeding a temperature threshold and/or in response to the current in said primary windings or said secondary windings exceeding a transformer current threshold.

4. A low voltage power supply and distribution center, according to claim 1, wherein said distribution means is a fuse panel and said circuit protection means are a plurality of fuses mounted thereon.

5. A low voltage power supply and distribution center, according to claim 4 wherein one fuse is associated with each low voltage distribution line, and each low voltage distribution line supplies power to one low voltage load.

6. A low voltage power supply and distribution center, according to claim 5 wherein each fuse is rated at 5 amps and wherein the magnitude said voltage supplied by said secondary windings to the low voltage distribution lines via said fuse panel and fuses is nominally 12 volts.

7. A low voltage power supply and distribution center, according to claim 4 wherein one fuse is associated with each low voltage distribution line, and each low voltage distribution line provides power to one or more low voltage loads.

8. A low voltage power supply and distribution center, according to claim 7, wherein each fuse is rated between 5 amps and 35 amps and wherein the magnitude said voltage supplied by said secondary windings to the low voltage distribution lines via said fuse panel and fuses is either nominally 12 volts or nominally 24 volts.

9. A low voltage power supply and distribution center, according to claim 7:

wherein the magnitude of said voltage supplied by said secondary windings to the low voltage distribution lines via said fuse panel and fuses is nominally 12 volts and each of said fuses is rated at 5 amps;

wherein the magnitude of said voltage supplied by said secondary windings to the low voltage distribution lines via said fuse panel and fuses is either nominally 12 volts or nominally 24 volts and each of said fuses is rated between 5 amps and 35 amps; or wherein the magnitude of said voltage supplied by said secondary windings to the low voltage distribution lines via said fuse panel and fuses is nominally 12 volts and at least one of said fuses is rated at 5 amps and at least one of the fuses is rated greater than 5 amps.

10. A low voltage power supply and distribution center, according to claim 2, further comprising switching means in said high voltage compartment connected between the high voltage supply line and said primary windings.

11. A low voltage power supply and distribution center, according to claim 10, wherein said switching means is a dimmer, and wherein said low voltage power supply and distribution center further comprises a choke in said high voltage compartment connected between said dimmer and said primary windings.

12. A low voltage power supply and distribution center, according to claim 11, further comprising manually resettable circuit breaker means in said high voltage compartment connected between said choke and said primary windings.

13. A low voltage power supply and distribution center, according to claim 12, wherein said transformer comprises a plurality of primary windings, and wherein said low voltage power supply and distribution center further comprises a voltage selector switch in said high voltage compartment connected in line between the high voltage supply line and said plurality of primary windings, said voltage selector switch having a plurality of switch positions, each switch position corresponding to one of said plurality of primary windings.

14. A low voltage power supply and distribution center, according to claim 13, wherein said low voltage distribution lines are live conductors, and wherein said low voltage power supply and distribution center further comprises a security auto fuse extension means in said high voltage compartment connected in line between the high voltage supply line and said primary windings.

15. A low voltage power supply and distribution center, according to claim 14, further comprising a plurality of removable knock-outs formed in said housing walls for providing wiring access to said low voltage compartment and said high voltage compartment.

16. A low voltage power supply and distribution center, according to claim 2 further comprising manually resettable circuit breaker means in said high voltage compartment connected between the high voltage supply line and said primary windings.

17. A low voltage power supply and distribution center, according to claim 10 further comprising manually resettable circuit breaker means in said high voltage compartment connected between said switching means and said primary windings.

18. A low voltage power supply and distribution center, according to claim 2 wherein said transformer comprises a plurality of primary windings, and wherein said low voltage power supply and distribution center further comprises a voltage selector switch in said high voltage compartment connected between the high voltage supply line and said plurality of primary windings, said voltage selector switch having a plurality of switch positions, each switch position corresponding to one of said plurality of primary windings.

19. A low voltage power supply and distribution center, according to claim 10 wherein said transformer comprises a plurality of primary windings, and wherein said low voltage power supply and distribution center further comprises a voltage selector switch in said high voltage compartment connected between said switching means and said plurality of primary windings, said voltage selector switch having a plurality of switch positions, each switch position corresponding to one of said plurality of primary windings.

20. A low voltage power supply and distribution center, according to claim 11 wherein said transformer comprises a plurality of primary windings, and wherein said low voltage power supply and distribution center further comprises a voltage selector switch in said high voltage compartment connected between said choke and said plurality of primary windings, said voltage selector switch having a plurality of switch positions, each switch position corresponding to one of said plurality of primary windings.

21. A low voltage power supply and distribution center, according to claim 2, wherein said low voltage distribution lines are live conductors, and wherein said low voltage power supply and distribution center further comprises a security auto fuse extension means in said high voltage compartment connected between the high voltage supply line and said primary windings.

22. A low voltage power supply and distribution center, according to claim 11, wherein said low voltage distribution lines are live conductors, and wherein said low voltage power supply and distribution center further comprises a security auto fuse extension means in said high voltage compartment connected between said switching means and said primary windings.

23. A low voltage power supply and distribution center, according to claim 10, wherein said low voltage distribution lines are live conductors, and wherein said low voltage power supply and distribution center further comprises a security auto fuse extension means in said high voltage compartment connected between said choke and said primary windings.

24. A low voltage power supply and distribution center, according to claim 1, further comprising a plurality of removable knock-outs formed in said housing walls for providing wiring access to said low voltage compartment and said high voltage compartment.

25. A low voltage power supply and distribution center, according to claim 1, further comprising a plurality of ventilation apertures formed in said housing cover and said side housing walls for ventilating said transformer compartment.

26. A low voltage power supply and distribution center, according to claim 1, wherein said housing is generally rectangular shaped, wherein said housing walls include a top side housing wall, a bottom side housing wall, a left side housing wall and a right side housing wall, and wherein said side said housing chamber is generally rectangular shaped.

27. A low voltage power supply and distribution center, according to claim 26 further comprising:

a hinge bracket having mounting apertures formed therein for secure mounting of said hinge bracket to a structural member within a wall or ceiling, said hinge bracket further comprising hinge means for mounting to said left side or said right side housing wall, said housing being mounted for swinging movement to said hinge bracket by said hinge means; and a latch bracket for mounting to said housing to one of said side walls opposite said hinge bracket, and wherein said latch bracket may be temporary or permanent secured to a second structural member within a wall or ceiling.

28. A low voltage power supply and distribution center, according to claim 26, further comprising a bubble level formed in said top side housing wall for leveling said housing.

* * * * *

UNITED STATES PATENT AND TRADEMARK OFFICE

CERTIFICATE OF CORRECTION

PATENT NO. : 5,510,948

DATED : April 23, 1996

INVENTOR(S) : Tremaine et al.

It is certified that error appears in the above-indentified patent and that said Letters Patent is hereby corrected as shown below:

Column 12, claim 1, line 54 insert --voltage -- before "power supply".

Column 13, claim 9, line 64 insert --or-- after "amps;"

Signed and Sealed this

Third Day of September, 1996

*Attest:*

*Attesting Officer*

BRUCE LEHMAN

*Commissioner of Patents and Trademarks*